US006185381B1

(12) United States Patent
Nakahara et al.

(10) Patent No.: US 6,185,381 B1
(45) Date of Patent: Feb. 6, 2001

(54) IMAGE FORMING APPARATUS

(75) Inventors: Takashi Nakahara, Moriya-machi; Hitoshi Ueki, Tsukuba; Tomoko Tanaka, Abiko; Kohei Maeda, Toride; Atsushi Wada, Toride; Hiroshi Fuse, Toride, all of (JP)

(73) Assignee: Canon Kabushiiki Kaisha, Tokyo (JP)

( * ) Notice: Under 35 U.S.C. 154(b), the term of this patent shall be extended for 0 days.

(21) Appl. No.: 09/467,176

(22) Filed: Dec. 20, 1999

(30) Foreign Application Priority Data

Dec. 22, 1998 (JP) ..... 10-365375

(51) Int. Cl.[7] ..... G03G 15/00; B65H 7/02

(52) U.S. Cl. ..... 399/21; 399/124; 399/401; 271/258.01

(58) Field of Search ..... 226/110; 271/258.01, 271/258.05, 259, 265.01, 265.02, 301; 399/16, 124, 322, 388, 389, 21, 22, 397, 400, 40, 401, 402

(56) References Cited

U.S. PATENT DOCUMENTS 4,671,441 * 6/1987 Hauslaib ..... 226/110
5,031,896 * 7/1991 Winkler ..... 271/258
5,582,399 * 12/1996 Sugiura ..... 271/10.11
5,974,290 * 6/1987 Inoue ..... 399/124

* cited by examiner

*Primary Examiner*—Susan S.Y. Lee
*Assistant Examiner*—Hoang Ngo
(74) *Attorney, Agent, or Firm*—Fitzpatrick, Cella, Harper & Scinto

(57) ABSTRACT

A position detecting sensor for detecting that a sheet having come into an openable both-face conveying path for reversing the surfaces of the sheet having an image formed on one surface thereof and conveying the reversed sheet to an image forming portion has arrived at a predetermined re-feeding position, and the position detecting sensor is designed to be capable of detecting also the presence or absence of the occurrence of jam in the both-face conveying path, the mounting and dismounting of a both-face conveying portion and the opening and closing of the both-face conveying path.

25 Claims, 6 Drawing Sheets

| | PRESENCE/ ABSENCE OF CONVEYING PORTION | OPEN/CLOSE OF CONVEYING PATH | PRESENCE/ ABSENCE OF SHEET |
|---|---|---|---|
| H | ABSENCE | OPEN | PRESENCE |
| L | PRESENCE | CLOSE | ABSENCE |

IMAGE FORMING APPARATUS

BACKGROUND OF THE INVENTION

1. Field of the Invention

This invention relates to an image forming apparatus such as a laser printer capable of two sided printing, that is forming images on the front and back surfaces of a sheet, and particularly to an image forming apparatus to the main body of which is detachably mountable two-sided copy a conveying portion (duplexing portion) for reversing the surfaces of a sheet having an image formed on one surface thereof and conveying it to an image forming portion.

2. Related Background Art

Some of conventional image forming apparatuses are such that a sheet having an image formed on one surface thereof by an image forming portion is reversed and is again conveyed to the image forming portion so that an image may be formed on the back surface of the sheet.

In an image recording apparatus such as a laser printer which is an example of the conventional image forming apparatuses, a two-sided copy conveying portion having a two-sided copy conveying path for reversing the front surface and back surface of a sheet and conveying the sheet to an image forming portion is optionally mounted on a relatively bulky, high-speed and high-cost apparatus so that images may be recorded on the both surfaces of the sheet.

Now, in recent years, even in compact, low-speed and low-cost laser printers, there is a growing trend toward including the function of recording images on the both surfaces of a sheet for the saving of natural resources, but when a two-sided copy conveying portion is to be optionally mounted on such a compact, low-speed and low-cost image recording apparatus, a two-sided copy conveying portion of low cost becomes requisite as a matter of course.

Such two-sided copy conveying portion, however, requires various sensors such as a jam detecting sensor for detecting, for example, the occurrence of jam in a two-sided copy conveying path and a jam clearance detecting sensor for detecting jam clearance being carried out, and the duplex conveying portion becomes high in cost.

Also, in the conventional image recording apparatus, when such a two-sided copy conveying portion is to be mounted, detecting means for detecting whether the two-sided copy conveying portion has been mounted must be newly provided and thus, the total cost of the apparatus becomes high.

SUMMARY OF THE INVENTION

So, the present invention has been made in view of such present situation, and has as its object to provide a low-cost image recording apparatus (image forming apparatus) capable of effecting two-sided copy image formation.

The present invention provides an image forming apparatus for reversing surfaces of a sheet having an image formed on one surface thereof by an image forming portion and then reconveying the sheet to the image forming portion, wherein an image is formed on the back surface of the sheet. The apparatus is provided with a two-sided copy conveying portion having an openable and closable two-sided copy conveying path for conveying the reversed sheet to the image forming portion, and detachably mounted to the image forming apparatus, and a position detecting sensor for detecting that the sheet having come into the two-sided copy conveying path has arrived at a predetermined position, the position detecting sensor being designed to be capable of detecting also the presence or absence of the occurrence of jam in the two-sided copy conveying path, the mounting or dismounting of the two-sided copy conveying portion, and the opening or closing of the two-sided copy conveying path.

Preferably, the position detecting sensor may be provided in the two-sided copy conveying portion, and may detect the mounting or dismounting of the two-sided copy conveying portion on the basis of a signal obtained when the two-sided copy conveying portion is mounted to the image forming apparatus.

Also, preferably, the position detecting sensor may output a signal in response to the opening or closing operation of the two-sided copy conveying path.

Also, preferably, the position detecting sensor may detect the occurrence of jam in the two-sided copy conveying path when the position detecting sensor does not detect the sheet having come into the two-sided copy conveying path within a predetermined time period.

Also, preferably, the position detecting sensor may be designed such that the same detected state is obtained for all of the occurring state of the jam, the unmounted state of the two-sided copy conveying portion and the opened state of the two-sided copy conveying path.

Also, preferably, the present invention may have an indicating portion for indicating one or more the occurrence of the jam, the unmounting of the two-sided copy conveying portion, or the opened state of the two-sided copy conveying path.

Also, preferably, the two-sided copy printing operation may be disabled when at least one of the occurrence of the jam, the unmounting of the two-sided copy conveying portion and the opened state of the two-sided copy conveying path is detected.

Also, preferably, the single sided printing operation may be enabled, but the two-sided copy printing operation may be disabled when at least one of the occurrence of the jam, the unmounting of the two-sided copy conveying portion and the opened state of the two-sided copy conveying path is detected.

DESCRIPTION OF THE PREFERRED EMBODIMENT

An embodiment of the present invention will hereinafter be described with reference to the drawings.

Figure 1:
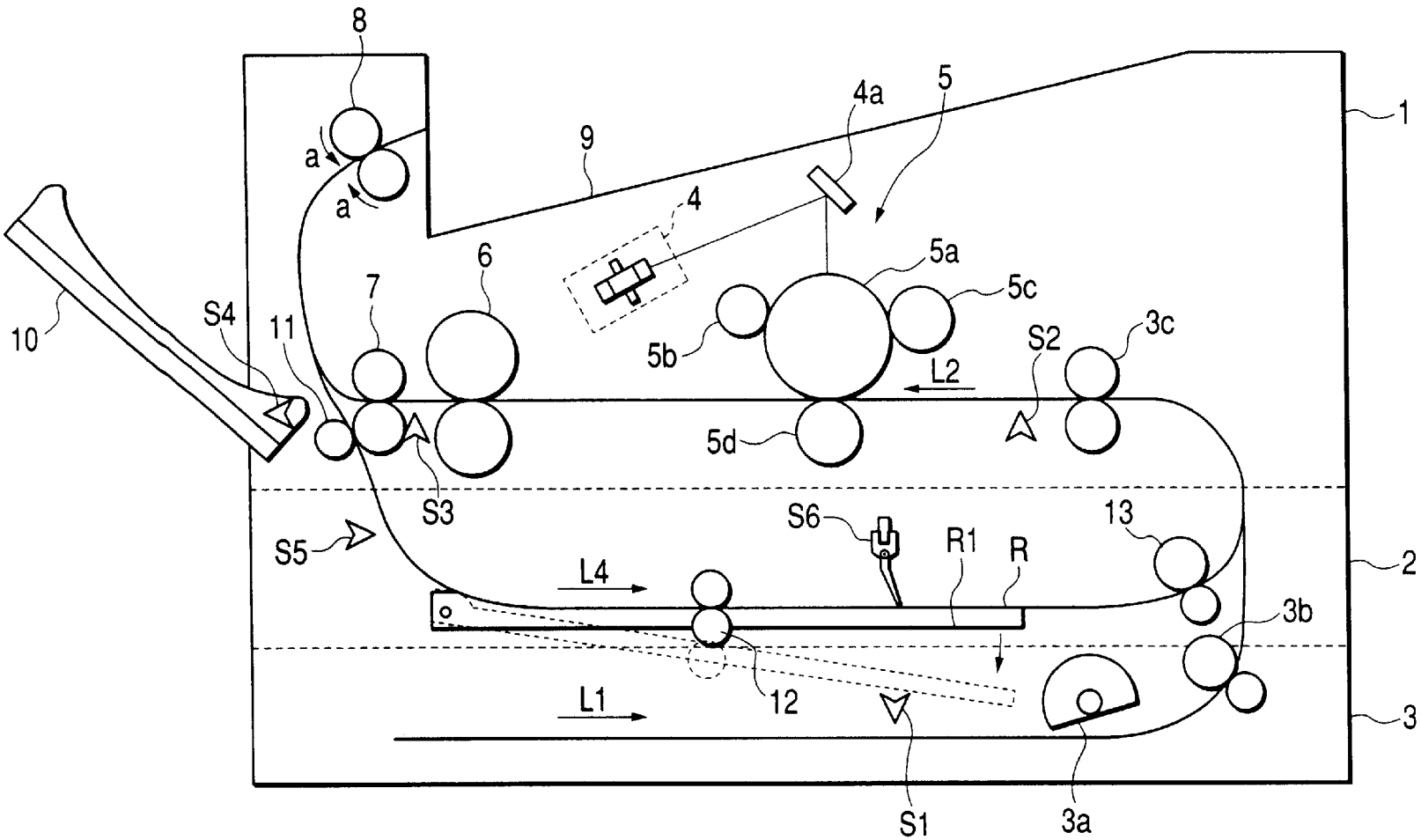
FIG. 1 schematically illustrates the construction of a laser beam printer which is an example of an image forming apparatus according to an embodiment of the present invention.

FIG. 1 schematically illustrates the construction of a laser beam printer which is an example of an image forming apparatus according to an embodiment of the present invention.

In FIG. 1, the reference numeral 1 designates the main body of the laser beam printer (hereinafter referred to as the main body), the reference numeral 2 denotes a two-sided copy conveying portion provided with an openable and closable two-sided copy conveying path R and detachably mounted to the main body 1, and the reference numeral 3 designates a sheet cassette containing sheets (paper), not shown, therein. The sheets contained in this sheet cassette 3 are fed one by one in the direction indicated by the arrow L1 by the driving of a cassette sheet pickup roller 3*a* and a pair of conveying rollers 3*b,* and thereafter are conveyed in the direction indicated by the arrow L2 by the driving of a pair of conveying rollers 3*c.*

In the two-sided copy conveying portion 2, as shown, for example, in FIG. 1, an openable and closable member R1 is provided on a portion of the bottom of the two-sided copy conveying path R, and is pivotally moved toward the bottom with the left pivot center as the axis, whereby the two-sided copy conveying path can be opened as indicated by dotted line in FIG. 1. At that time, a pair of reversed sheet conveying rollers 12 are spaced apart from each other to thereby facilitate the removal of the sheet.

The reference numeral 4 denotes a laser scanner unit which raster-scans a laser beam on the basis of image data from a host computer or the like which will be described later, and forms an electrostatic latent image on a photosensitive drum 5*a* charged in advance by a charger 5*b* by a reflecting mirror 4*a.* The electrostatic latent image formed on the photosensitive drum 5*a* may be toner-developed by a developing device 5*c,* whereafter in a transfer portion 5*d,* a toner image may be transferred to the sheet conveyed by the pair of conveying rollers 3*c.*

Further, the toner image transferred onto the sheet may be fixed on the sheet by a thermal fixing device 6. This thermal fixing device 6 is comprised of a heating member, not shown, and a thermistor or the like for detecting the temperature of the heating member, and is designed to apply heat and pressure to the sheet subjected to the transferring process and fix the toner image on the sheet.

The reference numeral 7 designates a pair of discharge rollers, by which the sheet passed through the thermal fixing device 6 may be discharged to a face-up tray 10 or a face-down sheet discharge portion 9. The face-up tray 10 is openably and closably provided on the main body 1, and when the sheet is to be discharged in its face-up state, this face-up tray 10 may be opened as shown in FIG. 1.

On the other hand, when the sheet is to be discharged in its face-down state, the face-up tray 10 may be closed. By the face-up tray 10 being thus closed, there is secured a conveying path for conveying the sheet to the face-down sheet discharge portion 9, and the sheet can be discharged to the face-down sheet discharge portion 9 by the driving of a pair of face-down sheet discharge rollers 8 in the direction indicated by the arrows a.

Also, when two-sided copy print (two-sided copy image formation) is to be effected, the face-up tray 10 is closed and the pair of face-down sheet discharge rollers 8 may be rotated for a predetermined time period to thereby convey the sheet toward the face-down sheet discharge portion 9, whereafter the rotation of the pair of face-down sheet discharge rollers 8 may be reversed so as to direct the sheet to the both-face conveying portion 2.

The sheet thus directed to the both-face conveying portion 2 may be conveyed to the both-face conveying path R by a reverse sheet inducing roller 11 and further, the sheet conveyed to this both-face conveying path R may be conveyed in the direction indicated by the arrow L4 by a pair of reverse sheet conveying rollers 12, whereafter the sheet may be stopped on this side of a pair of reverse sheet re-feeding rollers 13 and may wait as a sheet for the second surface (back surface) of two-sided copy print until the sheet is re-fed.

Now, in FIG. 1, the reference character S6 denotes a re-feeding sensor which is a position detecting sensor provided in the both-face conveying portion 2, and when the re-feeding sensor S6 detects that the sheet conveyed to the two-sided copy conveying path R has arrived at a predetermined re-feeding position, the re-feeding sensor S6 may output a detection signal to an engine controller portion 14 which is control means shown in FIG. 2 which will be described later.

The engine controller portion 14 may stop the pair of reverse sheet conveying rollers 12 on the basis of the detection signal from the re-feeding sensor S6 to thereby cause the sheet to wait at the predetermined re-feeding position, whereafter the pair of reverse sheet re-feeding rollers 13 may be driven at predetermined timing. Thereby, the sheet waiting in the both-face conveying path R may be re-fed to the image forming portion 5 via the pair of conveying rollers 3*c,* whereafter the printing operation for the second surface (back surface) of two-sided copy print may be performed in a conveying path similar to that in the printing operation from the aforedescribed sheet cassette 3, whereafter the sheet may be discharged to the face-down sheet discharge portion 9.

In FIG. 1, the reference character S1 designates a sheet sensor for detecting the presence or absence of sheets in the sheet cassette 3, and the reference character S2 denotes a sheet feeding sensor for detecting the leading end and trailing end of the sheet conveyed by the driving of the pair of conveying rollers 3*c,* and on the basis of a detection signal from this sheet feeding sensor S2, the engine controller portion 14 may determine image writing timing.

The reference character S3 designates a passage detecting sensor for detecting that the sheet has passed through the thermal fixing device 6, and the reference character S4 denotes a face-up tray opening-closing detecting sensor for detecting the opening and closing of the face-up tray 10, and when it is detected by this face-up tray opening-closing detecting sensor S4 that the face-up tray 10 is closed, the already described face-down sheet discharge and the conveyance of the sheet to the two-sided copy conveying path R may be effected. The reference character S5 designates a reverse sheet induction detecting sensor for detecting the timing at which the sheet has been conveyed to the two-sided copy conveying path R and the leading end and trailing end of the sheet.

Figure 2:
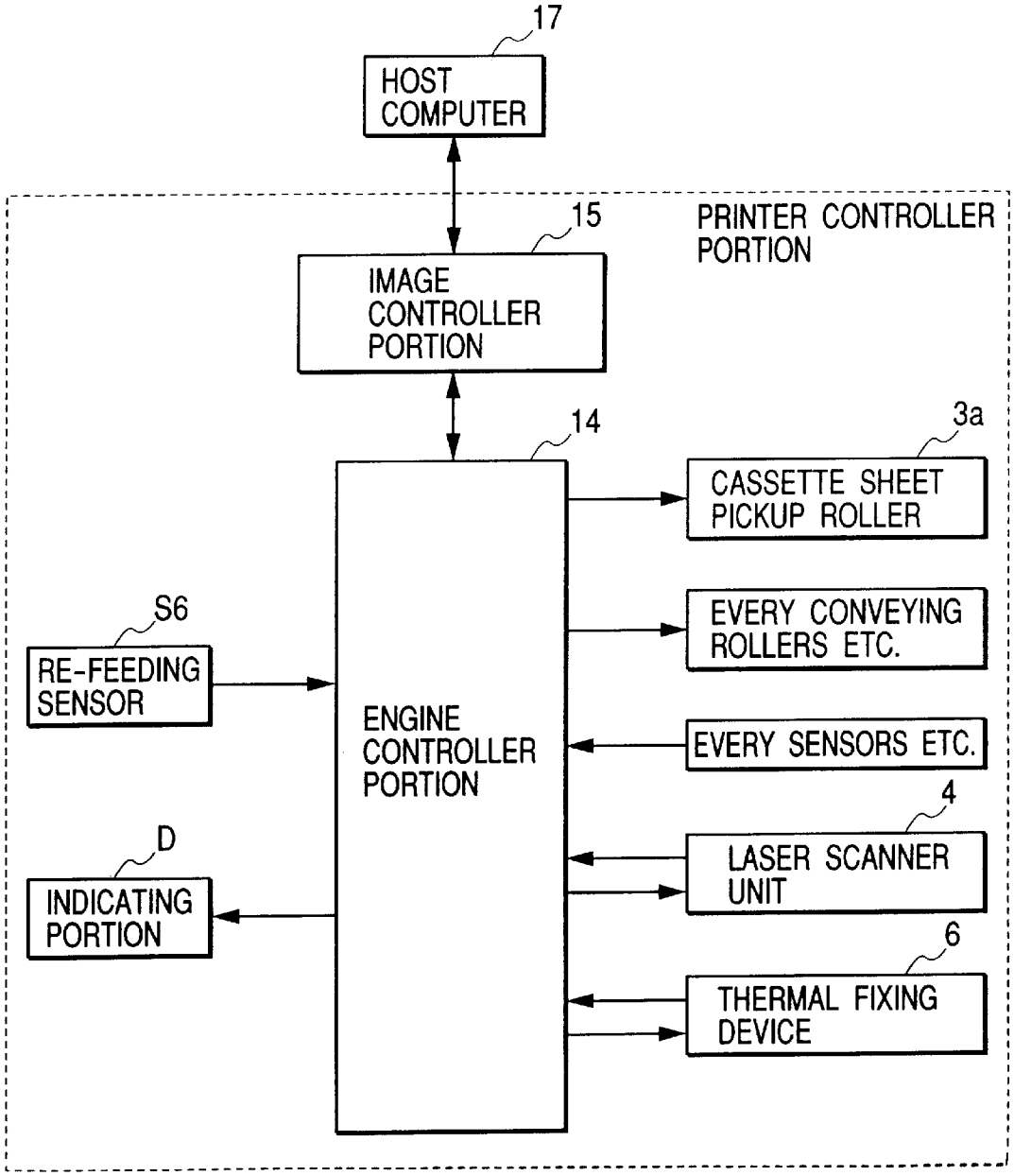
FIG. 2 is a control block diagram of the laser beam printer.

Now, the engine controller portion 14 is adapted to detect on the basis of a detection signal from the re-feeding sensor S6 that the reversed sheet has been jammed on the two-sided copy conveying path when, for example, the detection signal from the re-feeding sensor S6 is not inputted within a predetermined time period from after a sheet trailing end detecting signal from the reverse sheet induction detecting sensor S5 has been inputted, and when the re-feeding sensor S6 detects the jam of the sheet, the jam of the sheet may be indicated on an indicating portion D in FIG. 2.

On the basis of this indication, a user or the like may open the openable and closable two-sided copy conveying path R as already described and clear the sheet on the two-sided copy conveying path. After the jammed sheet has thus been cleared, the two-sided copy conveying path R may be closed, whereby ordinary two-sided copy conveyance is secured.

FIG. 2 is a block diagram of a printer controller portion for controlling the above-described series of printing operations, and this printer controller portion is comprised chiefly of the engine controller portion 14 and an image controller portion 15.

The image controller portion 15 is designed to receive encoded image information (code data) from a host computer 17 or the like through an outside interface, not shown, and thereafter convert the code data into the video data of a dot image and deliver a printing command to the engine controller portion 14 through a video interface, not shown, and deliver the video data successively to the engine controller portion 14 in synchronism with a main scanning and sub-scanning synchronizing signal from the engine controller portion 14.

Also, the engine controller portion 14 is for monitoring the driving of the rollers such as the cassette sheet pickup roller 3*a* and the pairs of conveying rollers and the inputs from the re-feeding sensor S6 and other sensors to thereby generally control the printer engines of the laser scanner unit 4, the thermal fixing device 6, etc. and print the video data from the image controller portion 15 on the sheet.

Further, this engine controller portion 14 is adapted to detect the occurrence of jam in the two-sided copy conveying path R on the basis of the signal from the re-feeding sensor S6 as already described, and effect only one-face printing when the re-feeding sensor S6 detects the occurrence of jam. Thereby, only one-face printing can be effected even if jam occurs on the two-sided copy conveying path R.

The engine controller portion 14 is adapted to give to the image controller portion 15 jam occurrence information and two-sided copy conveying path opening information when jam occurs on the two-sided copy conveying path R, and the information of the absence of the both-face conveying portion when the two-sided copy conveying portion is absent. Thereby, the image controller portion 15 comes to maintain a state in which only single sided printing is possible. Also, design may be made such that at this time, a necessary one of the jam occurrence information, the two-sided copy conveying path opening information and the information of the absence of the two-sided copy conveying portion is arbitrarily indicated on the indicating portion D shown in FIG. 2 to thereby give a warning to the user.

Figures 3, 4:
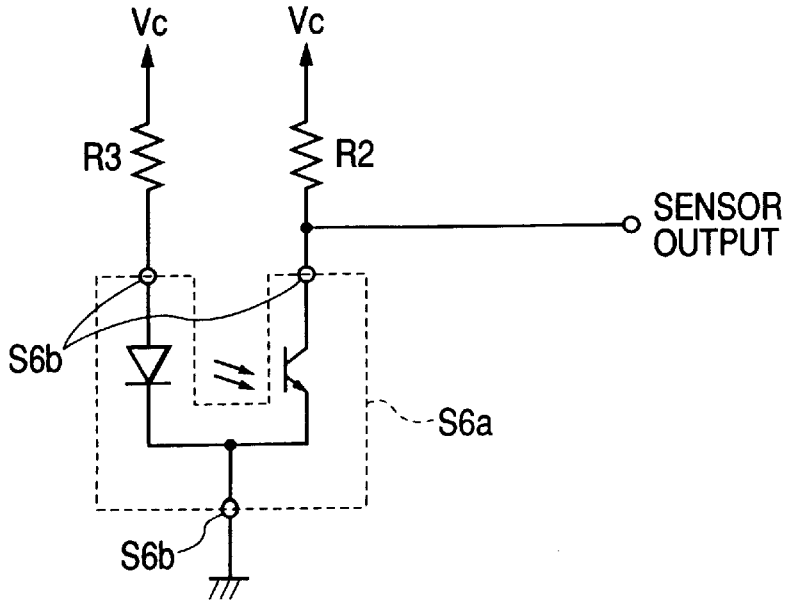
FIG. 3 is a table showing the judgment of states by a re-feeding sensor provided in the two-sided copy conveying portion of the laser beam printer.
FIG. 4 represents the state of connection of a photointerrupter with the image forming apparatus.

FIG. 3 is a table showing the judgment of states by the re-feeding sensor S6. When the two-sided copy conveying portion 2 is not mounted on the main body 1, the re-feeding sensor S6 provided in the both-face conveying portion 2 is not connected to the engine controller portion 14 and therefore, a High signal indicative of it is inputted to the engine controller portion 14, whereby the engine controller portion 14 judges that two-sided copy printing is impossible.

On the other hand, when the two-sided copy conveying portion 2 is mounted on the main body 1, and if a reversed sheet is absent on the two-sided copy conveying path R, the detecting state of the re-feeding sensor S6 becomes Low, whereby the engine controller portion 14 judges that two-sided copy printing is possible. Also, when there is a reversed sheet on the two-sided copy conveying path and when the reversed sheet is conveyed, the detecting state of the re-feeding sensor S6 becomes High as a sheet being present, whereby the engine controller portion 14 judges that two-sided copy printing is impossible. When a two-sided copy sheet is conveyed and passes the re-feeding sensor S6, the detecting state of the re-feeding sensor S6 becomes Low as a sheet being absent.

When the two-sided copy conveying path R is opened to clear a jammed sheet in the two-sided copy conveying path, the re-feeding sensor S6 becomes High in the same state as a sheet being present, whereby the engine controller portion 14 judges that two-sided copy printing is impossible.

As described above, the occurrence of jam, the unmounting of the two-sided copy conveying portion 2, the opening of the two-sided copy conveying path R and the presence or absence of a reversed sheet in the two-sided copy conveying path R are detected by the use of the re-feeding sensor S6, whereby a two-sided copy conveying portion 2 of low cost which does not require many sensors can be constructed and also it becomes unnecessary to provide a sensor for detecting the unmounting of the two-sided copy conveying portion 2 in the main body 1 and thus, the total cost of the apparatus can be reduced.

In all abnormal cases such as the case in that the two-sided copy conveying portion is not mounted, the case in that jam has occurred and the case in that the both-face conveying path is in its opened state, the same detecting state is brought about. In the present embodiment, the position detecting sensor S6 is constructed such that High signal is obtained in any case. By doing so, the sensing of the abnormal cases is made easy and it becomes possible to enhance the reliability of the apparatus.

An example of the construction of the re-feeding sensor S6 for achieving such action and function is shown in FIGS. 4 to 7.

FIG. 4 represents the connected state of a photointerrupter S6*a* constituting the re-feeding sensor S6 to the image forming apparatus. The photointerrupter S6*a* is provided in the two-sided copy conveying portion 2, and is designed to be connected to the image forming apparatus 1 through a connector S6*b*. A voltage Vc is applied from the image forming apparatus 1 side through resistors R3 and R2. In the state as shown in FIG. 4, the sensor output is a Low output, but when taken off the connector, it becomes High output by the pull-up in the resistor R2. Accordingly, when the both-face conveying portion 2 is mounted, Low signal is obtained from the re-feeding sensor S6, and the mounting of the two-sided copy conveying portion can be detected by this signal.

By the use of the photointerrupter S6*a* as described above, a method of detecting the opening and closing of the openable and closable member R1 of the two-sided copy conveying path and a method of detecting the presence or absence of a sheet in the two-sided copy conveying path will hereinafter be described with reference to FIGS. 5, 6 and 7.

Figure 5:
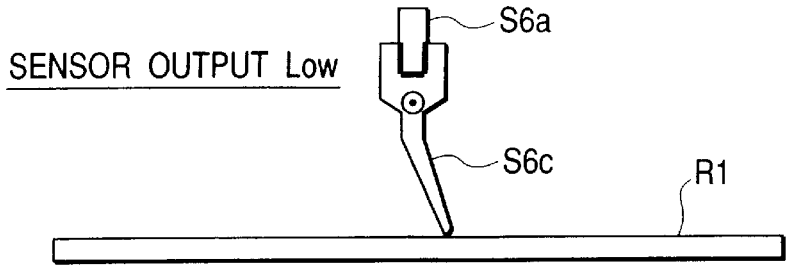
FIG. 5 represents a state in which a two-sided copy conveying path is closed and a sheet is absent.

FIG. 5 represents a state in which the two-sided copy conveying path is closed and a sheet is absent. In FIG. 5, a flag member S6*c* is pivotally provided near the photointerrupter S6*a*, and the distal end of the flag member S6*c* bears against the openable and closable member R1 with the aid of gravity. At this time, the flag member S6*c* is at a position in which the flag member S6*c* does not intercept the light in the photointerrupter and therefore, the sensor output is Low.

Figure 6:
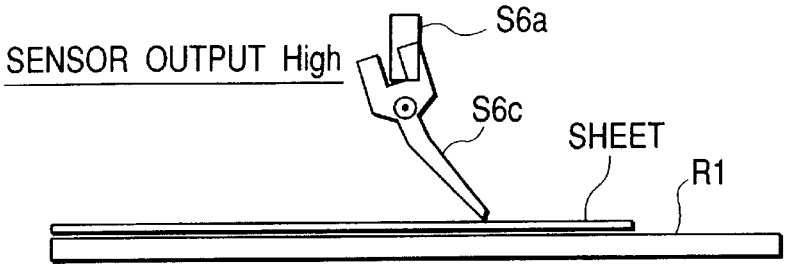
FIG. 6 represents a state in which the two-sided copy conveying path is closed and a sheet is present.

FIG. 6 represents a state in which the two-sided copy conveying path is closed and a sheet is present. In FIG. 6, the flag member S6*c* bearing against the sheet is inclined, whereby the flag member S6*c* intercepts the light in the photointerrupter and the sensor output becomes High.

Figure 7:
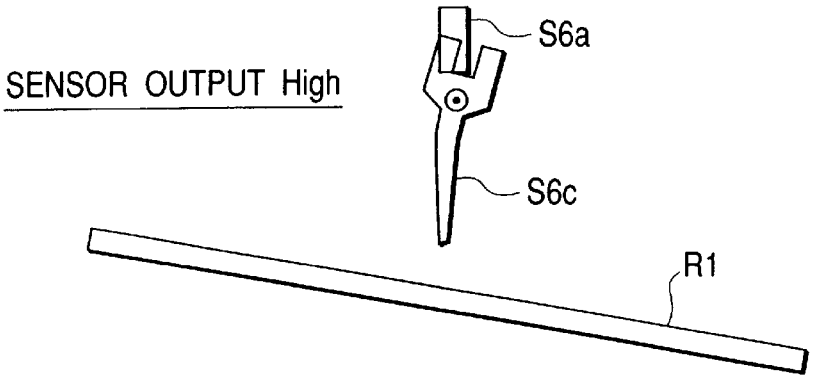
FIG. 7 represents a state in which the two-sided copy conveying path is opened.

FIG. 7 represents a state in which the two-sided copy conveying path is opened. In FIG. 7, the distal end of the flag member S6*c* bears against nothing and therefore exists at a position in which the flag member S6*c* is stable only by its self-weight. At this time, the flag member is designed to intercept the light in the photointerrupter, whereby the sensor output becomes High.

Figure 8:
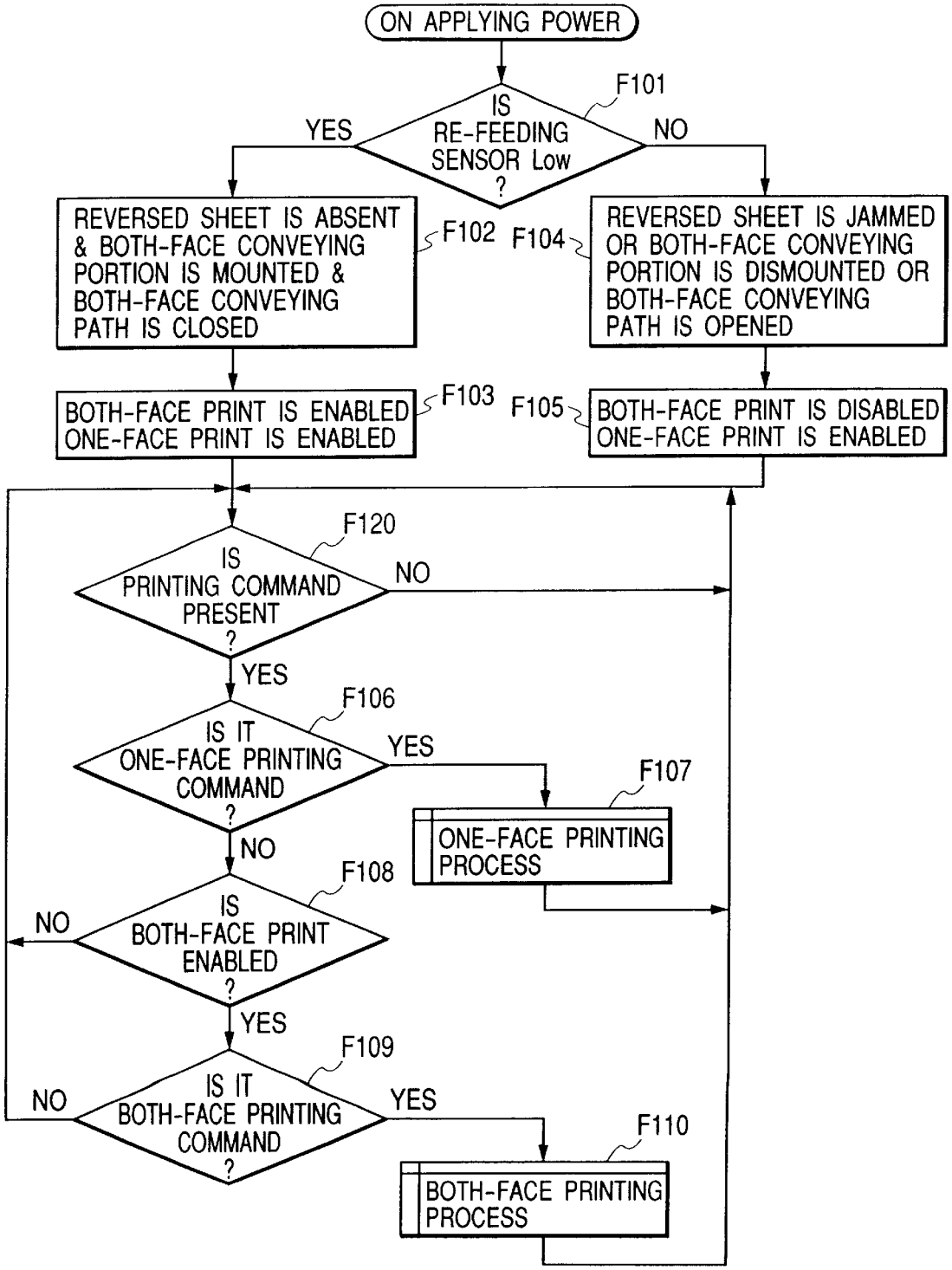
FIG. 8 is a flowchart illustrating the image formation controlling operation of an engine controller portion using the re-feeding sensor.

The image formation controlling operation of the engine controller portion 14 using the thus constructed re-feeding sensor S6 will now be described with reference to a flowchart shown in FIG. 8.

On the application of power, the engine controller portion 14 first examines the signal of the re-feeding sensor S6 (F101), and if the signal of the re-feeding sensor S6 is Low (YES of F101), it concludes that there is no reversed sheet and the both-face conveying portion is mounted and the two-sided copy conveying path is closed (F102), and both-face print is enabled and single-sided print is enabled (F103). In this state, the engine controller portion 14 waits for a printing command from the image controller portion 15 (F120).

On the other hand, if the re-feeding sensor S6 is High (NO of F101), one of a state in which a reversed sheet is jammed, a state in which the two-sided copy conveying path is dismounted and a state in which the two-sided copy conveying path is opened is judged (F104), and two-sided copy print is disabled and one-face print is enabled (F105). In this state, a printing command from the image controller portion 15 is waited for.

Next, when there is present a printing command from the image controller portion 15 (YES of F120), and if this printing command is a one-face printing command (YES of F106), the single-sided copy printing process is carried out (F107), and when the printing is completed, the next printing command is waited for. Also, if the printing command is not a single-sided printing command (NO of F106), whether two-sided copy print is enabled is judged (F108), and if both-face print is disabled (NO of F108), return is made to F120, where a printing command is again waited for.

On the other hand, if two-sided copy print is enabled (YES of F108) and the printing command from the image controller portion 15 is a two-sided copy printing command (YES of F109), the two-sided copy printing process is carried out (F110). Also, if the printing command is not a two-sided copy printing command (NO of F109), return is made to F120, where a printing command is again waited for.

Figure 9:
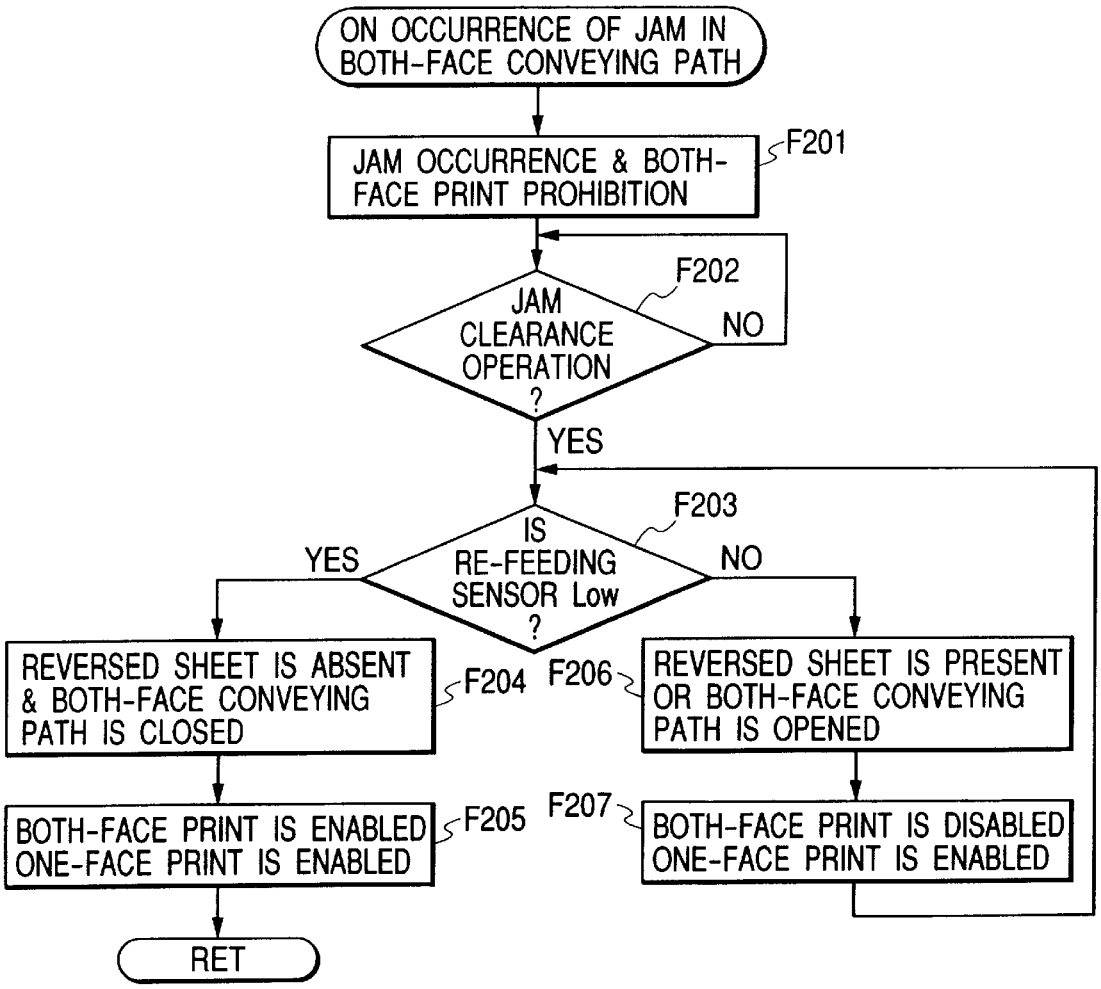
FIG. 9 is a flowchart illustrating the processing operation on the occurrence of jam in the two-sided copy conveying path in the engine controller portion.

Now, when during the two-sided copy printing process at F110, the jam of a sheet in the two-sided copy conveying path is detected by the re-feeding sensor S6, the processing as shown in FIG. 9 is carried out.

That is, when the jam of a sheet in the two-sided copy conveying path is detected by the re-feeding sensor S6, the occurrence of jam (the presence of a jammed sheet) and two-sided copy print prohibition (the opened state of the two-sided copy printing function) are reported to the image controller portion 15 (F201). That state is maintained until the jam clearance operation is performed (NO of F202). Thereafter, when the jam clearance operation is performed (YES of F202), whether the re-feeding sensor S6 is Low or High at this time is judged (F203).

If the re-feeding sensor S6 is Low (YES of F203), the absence of a reversed sheet and the closed state of the two-sided copy conveying path are judged (F204), and two-sided copy print is enabled and one-face print is enabled (F205) and the reporting of the jammed state of the two-sided copy conveying path is released.

Also, if the re-feeding sensor S6 is High (NO of F203), the presence of a reversed sheet or the opened state of the two-sided copy conveying path is judged (F206), and two-sided copy print is disabled and single-sided print is enabled (F207). Thereafter, jump is made to F203, where the monitoring by the re-feeding sensor S6 is continued.

At F207, the engine controller portion 14 disables two-sided copy print and enables one-face print, and also reports the occurrence of jam and the information of the opening of the two-sided copy conveying path to the image controller portion 15. By the occurrence of jam and the information of the opening of the two-sided copy conveying path, the image controller portion 15 maintains a state in which only single-sided print is enabled.

As described above, according to the present invention, there can be provided an image forming apparatus which can detect the occurrence of jam in the two-sided copy conveying path, the mounting and dismounting of the two-sided copy conveying portion having the two-sided copy conveying path to and from the main body of the apparatus and the opening and closing of the two-sided copy conveying path by the use of the position detecting sensor for detecting that a sheet having come into the two-sided copy conveying path has arrived at a predetermined re-feeding position, without the addition of any new sensor, to thereby form two-sided copy images at a low cost.

Also, there can be provided a user-friendly image forming apparatus in which the absence of the two-sided copy conveying portion, the occurrence of jam in the two-sided copy conveying path and the information of the opening of the two-sided copy conveying path are reported to the image controller portion, whereby a state in which only one-face print is enabled can be maintained when the both-face conveying portion is not mounted, or when jam has occurred or when the both-face conveying path is opened.

Further, there can be provided a user-friendly image forming apparatus which is comprehensible to the user by indicating the absence of the two-sided copy conveying portion, the occurrence of jam in the two-sided copy conveying path and the information of the opening of the two-sided copy conveying path.

What is claimed is:

1. An image forming apparatus for reversing surfaces of a sheet having an image formed on one surface thereof by an image forming portion and re-conveying the reversed sheet to said image forming portion for image formation on a second surface of said sheet, said image forming apparatus comprising:

a two-sided copy conveying portion having an openable and closable two-sided copy conveying path for conveying the reversed sheet to the image forming portion, said two-sided copy conveying portion detachably mounted to said image forming apparatus; and a position detecting sensor means for detecting a sheet in said two-sided copy conveying path at a predetermined position, said position detecting sensor means also for detecting a jam in said two-sided copy conveying path, a detachment of said two-sided copy conveying portion, and an opening and closing of said two-sided copy conveying path.

2. An image forming apparatus according to claim 1, wherein said position detecting sensor means is provided in said two-sided copy conveying portion, and detects the mounting and dismounting of said two-sided copy conveying portion based on a signal obtained when said two-sided copy conveying portion is mounted to said image forming apparatus.

3. An image forming apparatus according to claim 1, wherein said position detecting sensor means outputs a signal in response to a movement of the opening and closing of said two-sided copy conveying path.

4. An image forming apparatus according to claim 1, wherein when said position detecting sensor means fails to detect the sheet in said two-sided copy conveying path within a predetermined time period, said position detecting sensor means detects it as the occurrence of jam in said conveying path.

5. An image forming apparatus according to claim 1, wherein a same detected state is obtained by said position detecting sensor means for all of the occurrence of the jam, the dismounting of said two-sided copy conveying portion and the opening of said two-sided copy conveying path.

6. An image forming apparatus according to any one of claims 1 to 5, further comprising indicating means for indicating at least one of the occurrence of said jam, the dismounting of said two-sided copy conveying portion and the opening of said two-sided copy conveying path.

7. An image forming apparatus according to any one of claims 1 to 5, wherein when at least one of the occurrence of said jam, the dismounting of said two-sided copy conveying portion and the opening of said two-sided copy conveying path is detected, a two-sided copy printing operation is disabled.

8. An image forming apparatus according to any one of claims 1 to 5, wherein when at least one of the occurrence of said jam, the dismounting of said two-sided copy conveying portion and the opening of said two-sided copy conveying path is detected, a single-side copy printing operation is enabled, and a two-sided copy printing operation is disabled.

9. An image forming apparatus for reversing surfaces of a sheet having an image formed on one surface thereof by an image forming portion and re-conveying a reversed sheet to said image forming portion for image formation on a second surface of said sheet, said image forming apparatus comprising:

a two-sided copy conveying portion having an openable and closable two-sided copy conveying path for conveying the reversed sheet to the image forming portion, said two-sided copy conveying portion detachably mounted to said image forming apparatus;

a position detecting sensor for detecting a sheet in said two-sided copy conveying path at a predetermined position; and control means for controlling a stoppage and conveyance of said sheet based on a detection signal from said position detecting sensor based on a detecting an occurrence of a jam in said two-sided copy conveying path, a mounting and dismounting of said two-sided conveying portion and an opening and closing of said two-sided copy conveying path by use of said position detecting sensor.

10. An image forming apparatus according to claim 9, wherein said position detecting sensor is provided in said two-sided copy conveying portion, and said control means detects the mounting and dismounting of said two-sided copy conveying portion based on a signal from said position detecting sensor inputted when said two-sided copy conveying portion is mounted to said image forming apparatus.

11. An image forming apparatus according to claim 9, wherein said position detecting sensor outputs a signal in response to the opening and closing of said two-sided copy conveying path, and said control means detects the opening and closing of said two-sided copy conveying path based on the signal from said position detecting sensor.

12. An image forming apparatus according to claim 9, wherein when said position detecting sensor fails to detect said sheet in said two-sided copy conveying path within a predetermined time period, said control means determines there is the occurrence of a jam of said sheet in said two-sided copy conveying path.

13. An image forming apparatus according to claim 9, wherein a same detected state is detected by said position detecting sensor for all of the occurrence of the jam, the dismounting of said two-sided copy conveying portion and the opening of said two-sided copy conveying path.

14. An image forming apparatus according to claim 9, further comprising an image controller for delivering image data to said control means, said control means forming an image on the sheet by said image forming portion in accordance with the image data, and the occurrence of said jam, the dismounting of said conveying portion and the opening of said two-sided copy conveying path are reported to said image controller.

15. An image forming apparatus according to any one of claims 9 to 14, further comprising indicating means for indicating at least one of the occurrence of said jam, the dismounting of said two-sided copy conveying portion and the opening of said two-sided copy conveying path.

16. An image forming apparatus according to any one of claims 9 to 14, wherein when at least one of the occurrence of said jam, the dismounting of said two-sided copy conveying portion and the opening of said two-sided copy conveying path is detected, a two-sided copy printing operation is disabled.

17. An image forming apparatus according to any one of claims 9 to 14, wherein when at least one of the occurrence of said jam, the dismounting of said two-sided copy conveying portion and the opening of said two-sided copy conveying path is detected, a single-side copy printing operation is enabled, and a two-sided copy printing operation is disabled.

18. An image forming apparatus for reversing surfaces of a sheet having an image formed on one surface thereof by an image forming portion and re-conveying the reversed sheet to said image forming portion for image formation on a second surface of said sheet, said image forming apparatus comprising:

a two-sided copy conveying portion having an openable and closable two-sided copy conveying path for conveying the reversed sheet to the image forming portion, said two-sided copy conveying portion detachably mounted to said image forming apparatus; and a position detecting sensor comprised of a photo interrupter and a pivotally mounted flag member, wherein said flag member is pivotal among positions sensing an absence of a sheet in said two-sided copy conveying path, a presence of a sheet in said two-sided copy conveying path and an opened state of said two-sided copy conveying path.

19. An image forming apparatus according to claim 18, wherein said position detecting sensor is provided in said two-sided copy conveying portion, and detects the mounting and dismounting of said two-sided copy conveying portion based on a signal obtained when said two-sided copy conveying portion is mounted to said image forming apparatus.

20. An image forming apparatus according to claim 18, wherein said position detecting sensor outputs a signal in response to an opening and closing of said two-sided copy conveying path.

21. An image forming apparatus according to claim 18, wherein when said position detecting sensor fails to detect the sheet in said two-sided copy conveying path within a predetermined time period, said position detecting sensor senses it as the occurrence of a jam in the two-sided copy conveying path.

22. An image forming apparatus according to claim 18, wherein a same detected state is obtained by said position detecting sensor for all of the occurrence of the jam, the dismounting of said two-sided copy conveying portion and the opening of said two-sided copy conveying path.

23. An image forming apparatus according to claim 18, further comprising indicating means for indicating at least one of the occurrence of said jam, the dismounting of said two-sided copy conveying portion and the opening of said two-sided copy conveying path.

24. An image forming apparatus according to claim 18, wherein when at least one of the occurrence of said jam, the dismounting of said two-sided copy conveying portion and the opening of said two-sided copy conveying path is detected, a two-sided copy printing operation is disabled.

25. An image forming apparatus according to claim 18, wherein when at least one of the occurrence of said jam, the dismounting of said two-sided copy conveying portion and the opening of said two-sided copy conveying path is detected, a single-side copy printing operation is enabled, and a two-sided copy printing operation is disabled.

* * * * *

UNITED STATES PATENT AND TRADEMARK OFFICE

CERTIFICATE OF CORRECTION

PATENT NO. : 6,185,381 B1
DATED : February 6, 2001
INVENTOR(S) : Takashi Nakahara et al.

It is certified that error appears in the above-identified patent and that said Letters Patent is hereby corrected as shown below:

Column 1,
Line 9, "mount[ab]le two-sided copy a" should read -- a mountable two-sided copy --.

Column 4,
Lines 6, 7, 9, 18, and 31, "both-face" should read -- two-sided copy --.

Column 5,
Lines 45 & 58, "both-face" should read -- two-sided copy --.

Column 6,
Line 29, "both-face" should read -- two-sided copy --.
Line 48, "both-" should read -- two-sided copy --.
Line 49, "face" should be deleted.

Column 7,
Lines 21 & 43, "both-face" should read -- two-sided copy --.
Line 22, "both-" should read -- two-sided copy --.
Line 23, "face" should be deleted.

Column 8,
Lines 38 & 40, "both-face" should read -- two-sided copy --.

Column 9,
Line 15, "of" should read -- of a --.
Line 57, "an" should read -- of an --.

Signed and Sealed this

First Day of January, 2002

*Attest:*

*Attesting Officer*

JAMES E. ROGAN
*Director of the United States Patent and Trademark Office*